US005609318A

United States Patent [19]

Scheh

[11] Patent Number: 5,609,318

[45] Date of Patent: Mar. 11, 1997

[54] BEVERAGE CONTAINER HOLDER

[76] Inventor: Curtis L. Scheh, 17460 Judson Rd., San Antonio, Tex. 78247

[21] Appl. No.: 555,068

[22] Filed: Nov. 8, 1995

[51] Int. Cl.[6] ..... A47K 1/08

[52] U.S. Cl. ..... 248/311.2; 248/302; 248/315

[58] Field of Search ..... 248/311.2, 312, 248/312.1, 315, 302, 303

[56] References Cited

U.S. PATENT DOCUMENTS

| | | | |
|---|---|---|---|
| D. 260,066 | 8/1981 | Dark | D7/70 |
| D. 260,067 | 8/1981 | Dark | D7/70 |
| D. 279,533 | 7/1985 | Gildart | D7/70 |
| D. 297,695 | 9/1988 | Dessart | D7/70 |
| D. 307,851 | 5/1990 | Polidoros | D7/601 |
| 2,601,571 | 6/1952 | Sverkerson | 211/74 |
| 3,239,180 | 3/1966 | Bachmann | 248/210 |
| 3,773,288 | 11/1973 | Bolton | 248/302 |
| 4,418,883 | 12/1983 | Cohen | 248/312.1 |
| 5,285,991 | 2/1994 | Carlson | 248/311.2 |

*Primary Examiner*—Leslie A. Braun
*Assistant Examiner*—Kimberly T. Wood
*Attorney, Agent, or Firm*—Richard C. Litman

[57] ABSTRACT

A beverage container holder provides for the holding of a champagne bucket or other similarly configured container, cantilevered from the edge of a table or other platform. The device thus does not require any space on the table, and further does not require a relatively costly and space consuming floor stand for the support of a champagne bucket or the like. The holder generally comprises a round ring adapted to hold a tapered cylindrical bucket or container therein, with a smoothly curved support leg extending therefrom and secured to the ring at a single point. The lower end of the support leg includes a single lower contact point, while the upper end of the leg includes a transverse member extending thereacross, in an approximate T configuration. The opposite ends of the transverse member form two upper contact points, with the single lower and two upper contact points defining a stable three point attachment for the holder. The device may be formed of round wire or rod, and may be plated in precious metals or otherwise as desired for corrosion resistance and an attractive appearance. Decorative patterns may be provided to enhance the appearance further, and to conceal joint reinforcements used to form a sturdy structure. The ends of the contact points may include pads thereon to preclude marring the surface to which the holder is attached.

20 Claims, 2 Drawing Sheets

BEVERAGE CONTAINER HOLDER

FIELD OF THE INVENTION

The present invention relates generally to racks and holders for various devices, and more specifically to a beverage container holder which is adapted to secure a beverage container, such as a wine or champagne bucket, cantilevered from the edge of a table or the like. The present holder depends upon the weight of the beverage container or bucket held therein, to secure the holder to the table due to the leverage applied to the gripping legs of the holder as it is applied to the table.

BACKGROUND OF THE INVENTION

A good wine or champagne is frequently an enjoyable accessory with a high quality meal, either in a fine restaurant or in the home. Often, however, a meal which is accompanied by a chilled wine or champagne tends to be quite an elaborate affair, with numerous courses, dishes, utensils, and table decorations as a part of the meal. This can be a problem insofar as table space is concerned, as understandably, restaurants tend to provide the smallest tables reasonably possible, in order to seat the greatest number of patrons possible. Even in the home, table space may be limited at a festive occasion with numerous guests who do not normally dine in that home.

Accordingly, it has become a common practice at such elegant meals, to place any iced beverage bottles in a separate rack or stand, which is placed adjacent the table in order to save space on the table. However, this leads to another problem, with the stand taking up aisle space or restricting the movement of waiters or servers between tables, and/or restricting the movement of diners as they move their chairs away from their tables. At times, a person may trip over such a stand, spilling the contents and destroying the mood of the evening. At the very least, from time to time a waiter may find it necessary to move the stand away from the table for which it is providing service, thereby creating a problem for diners using the stand and beverage bottle therein. As diners in such circumstances correctly expect excellent service and a top quality experience, such inconvenience is normally not well accepted.

Accordingly, a need will be seen for a beverage container holder which is readily accessible to diners at a dining table, but which neither takes up table space nor floor space adjacent to the table. The holder or rack is cantilevered from the table edge, thereby automatically placing any contents thereof readily to hand, yet freeing the table surface area and keeping the floor space clear.

DESCRIPTION OF THE PRIOR ART

U.S. Pat. No. 3,239,180 issued to Erik H. Bachmann on Mar. 8, 1966 describes a Can Holder, comprising a wire loop with a crossmember extending therefrom which rests against the front face of a ladder upright. A hook extends therefrom which hooks around the back of an adjacent ladder rung. The device does not depend upon the upper and lower surfaces of a planar sheet of material for its support, but rather on opposite sides of two perpendicular members of an open frame type structure, such as a ladder upright and open rungs therebetween. The device is not symmetrical, with only one upright and rung attachment being provided; this structure cannot provide the desired stability for use on a uniform, flat sheet, such as a table.

U.S. Pat. No. 5,285,991 issued to Arthur E. Carlson on Feb. 15, 1994 describes a Card Table Mounted Food And Beverage Holding Apparatus, wherein several embodiments are secured to the generally vertical leg and hinge mechanism of a folding table. In at least some embodiments, a clamp is used to secure about the table leg. In contrast, the present container holder is not at all dependent upon the leg or any other vertical member of a table, but grips opposite generally horizontal surfaces of a table or other flat, planar structure to provide the desired cantilevered configuration.

U.S. Pat. No. D-260,066 issued to Ralph A. Dark on Aug. 4, 1981 describes a design for a Combined Wine Bucket And Table Attachment Bracket. The bracket appears to require mechanical attachment (screws) to the table, and has a square tube socket into which a mating square shaft from the bucket is installed. At least a part of the apparatus is permanently secured to the table, unlike the completely removable nature of the present holder. The Dark device may only be assembled to a single table, due to the dedicated attachment portion which requires holes to be formed in the underside of the table, for attachment. The present device is easily transferrable between different tables and requires no permanent attachment holes or other modifications to a table.

U.S. Pat. No. D-260,067 issued to Ralph A. Dark on Aug. 4, 1981 describes a design for a Combined Wine Bucket And Table Attachment Bracket. In this design, the attachment bracket is a permanent component of the bucket assembly, and comprises a C-clamp type bracket extending from one side of the bucket. The device must be clamped to the edge of a table, rather than being automatically secured in place due to the lever action of the plural legs extending above and below the table to form a cantilever attachment base for the bucket holder.

U.S. Pat. No. D-279,533 issued to Richard F. Gildart on Jul. 9, 1985 describes a design for a Wine Bucket, having a plurality of legs extending therefrom and apparently adapted to grip the edge of a table or the like in cantilever fashion. However, the legs of the Gildart device are apparently riveted to the sides of the wine bucket, and form a permanent assembly therewith. Thus, it is not possible to use a different wine bucket having a different shape than the generally circular planform with flattened sides disclosed by Gildart, with his apparatus.

U.S. Pat. No. D-297,695 issued to Yves Dessart on Sep. 20, 1988 describes a design for a Container Stand For The Table, apparently comprising a circular ring formed of a flat sheet of material with two symmetrical curved rod or wire elements extending therefrom to define two upper and two lower table contact points. In some of the views, the curved elements appear to be secured to a flat crossmember, to which the circular ring is apparently in turn attached; the bucket support ring does not directly secure to the table attachment elements as in the present invention, thus creating a more complex and potentially weaker structure which would be more prone to breakage. The present invention has several advantages over the Dessart device, in that (1) only three structural pieces are used in the present invention, thus forming a stronger structure with a minimum number of joints; (2) all of the components of the present invention are formed of the same material, thus reducing material costs and simplifying manufacture; and (3) The tripod table attachment configuration of the three contact points of the present invention, results in an automatically stable attachment, as three non-linear points define a plane, whereas the Dessart device requires four contact points, and if any one of them is not perfectly aligned, some instability is introduced.

U.S. Pat. No. D-307,851 issued to Nicolas Polidoros on May 15, 1990 describes a design for an Ice Bucket Holder, apparently comprising a round wire ring with opposite wire components extending therefrom to provide two upper and two lower table surface contact points. As in the Dessart device discussed immediately above, the four contact points must be perfectly aligned in order to provide the proper stability, whereas the three contact points provided by the present invention automatically define a stable contact plane. Moreover, the relatively sharp bends of the Polidoros device tend to concentrate bending stresses at those points, thus potentially weakening the structure. It is also noted that Polidoros requires considerably more material than the elegant configuration of the present invention, as Polidoros extends each of the legs to attach respectively to opposite sides of the bucket ring. The table attachment portion of the present beverage container holder attaches to the ring at only a single weld reinforced point.

Finally, Canadian Patent No. 633,694 issued to Joseph A. Raysinger on Jan. 2, 1962 describes a Pail Support formed from a single length of wire or the like, and adapted to hook around the upright or rail of a ladder and to brace upon one of the rungs. No ring is provided to support a bucket or pail; rather, the device is adapted to support a pail having a bail extending therefrom, with a loop formed in one portion of the wire length in which the bail may be secured. A bottom support is also provided for the paint can or other article secured therein, unlike the completely open bucket support ring of the present invention.

None of the above noted patents, taken either singly or in combination, are seen to disclose the specific arrangement of concepts disclosed by the present invention.

SUMMARY OF THE INVENTION

By the present invention, an improved beverage container holder is disclosed.

Accordingly, one of the objects of the present invention is to provide an improved beverage container holder which is adapted to secure to the edge of a table or like platform automatically, by means of plural legs extending therefrom which grip the table or platform on opposite sides thereof, with the weight of any article placed within the holder and clear of the table surface serving to counterbalance the holder and cause the legs to grip the table or surface securely.

Another of the objects of the present invention is to provide an improved beverage container holder which holder portion comprises a single ring, adapted for a tapered bucket or the like to seat securely therein.

Yet another of the objects of the present invention is to provide an improved beverage container holder which is formed of only three pieces of wire or rod, with the wire or rod being smoothly curved and having a round cross section to preclude the marring of or damage to any surfaces due to contact with any sharp edges or corners of the present holder, an which smooth curves obviate any stress concentrations in the holder structure.

Still another of the objects of the present invention is to provide an improved beverage container holder which extension legs provide grip at only three points, with the three points defining a stable plane through the table or platform surface to which the present holder is secured.

A further object of the present invention is to provide an improved beverage container holder which three grip points comprise a pair of upper grip points and a single lower grip point.

An additional object of the present invention is to provide an improved beverage container holder which primary leg member is secured to the holder ring at a single point, and which includes an upper grip arm extending thereacross in a T configuration.

Another object of the present invention is to provide an improved beverage container holder which may include reinforcement at one or more joints thereof, which reinforcement or joints may be concealed by decorative means thereon and thereover.

Yet another object of the present invention is to provide an improved beverage container holder which may be formed of stainless or other steel material, and/or which may be plated with chrome, brass, silver, and/or gold, or other plating, as desired.

Still another object of the present invention is to provide an improved beverage container holder which may include padding at the distal ends of the grip means, thereby precluding damage to a table or other platform to which the present holder is removably secured.

A final object of the present invention is to provide an improved beverage container holder for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 3 is a rear elevation view of the present beverage container holder through line 3—3 of FIG. 2, showing the three table contact points of the present holder when it is secured in place on a table or the like.

Similar reference characters denote corresponding features consistently throughout the several figures of the attached drawings.

DETAILED DESCRIPTION OF THE PREFERRED EMBODIMENT

Figure 1:
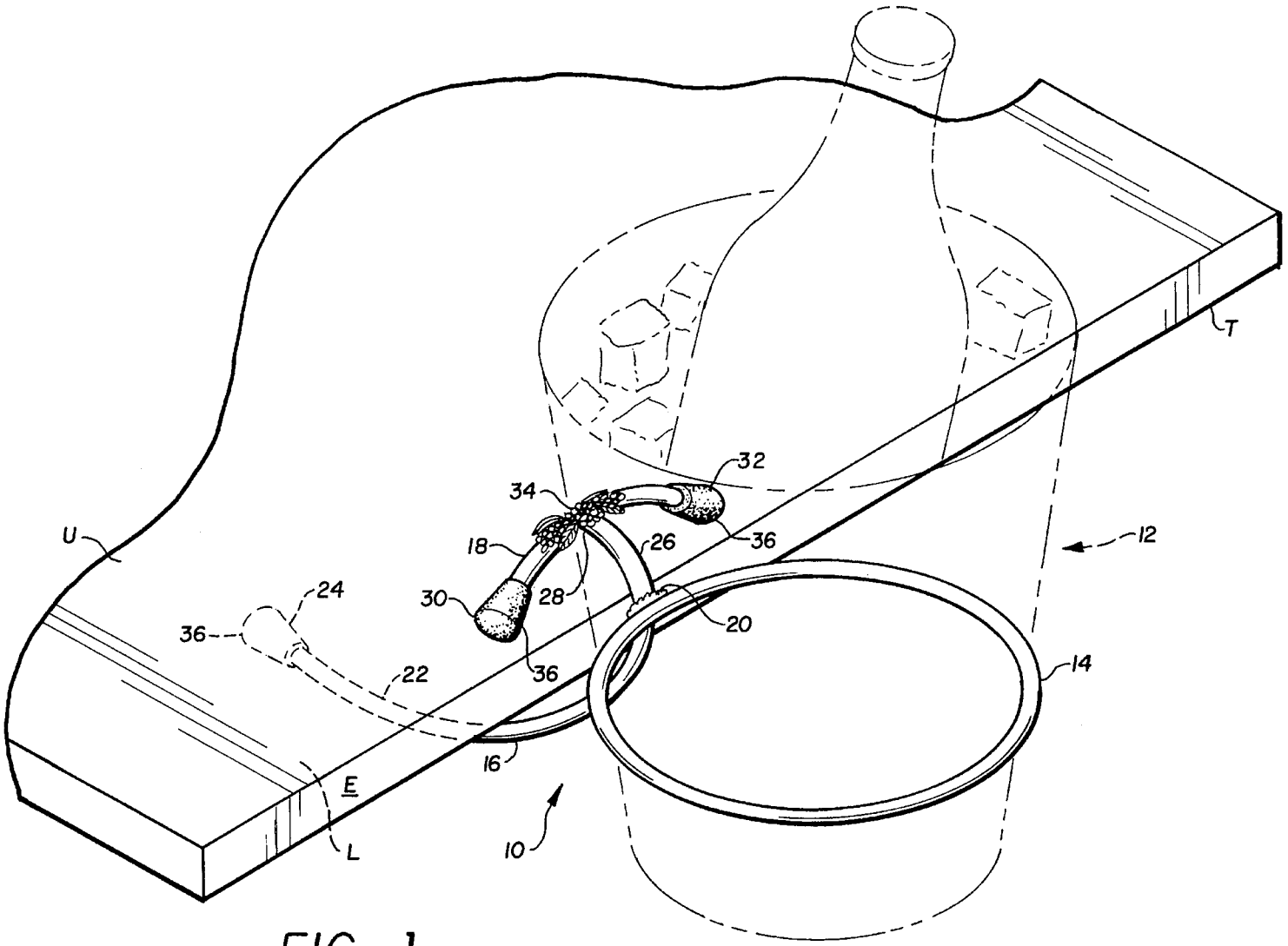
FIG. 1 is a top and side environmental perspective view of the present holder, showing its attachment to a table and its support of beverage container.

Referring now particularly to FIG. 1 of the drawings, the present invention will be seen to relate to a beverage container holder 10, adapted to hold a beverage container 12 (e. g., ice bucket for chilled wine, champagne, etc.) removably therein. The holder 10 may be formed of a reasonably heavy metal wire or metal rod or the like, preferably having a round cross section as shown in the drawing figures in order to preclude the scratching or marring of a surface due to any sharp corners or edges. The holder 10 essentially comprises three basic components: (1) a circular beverage container ring 14, (2) a first support leg 16 permanently secured to the ring 14 and normal to the plane of the ring 14, and (3) second support leg member 18 extending from the first leg 16.

The circular ring 14 may be formed to have a diameter as desired, depending upon the size of the bucket or container 12 to be removably installable therein. In any case, the ring is particularly adapted for the holding of a container or bucket 12 therein, which has a tapered cylindrical shape similar to the bucket 12 shown in broken lines in FIG. 1. (The broken line showing of the bucket 12 in FIG. 1 is for clarity in the drawings, to avoid obscuring details of the holder 10 structure.) With a tapered cylindrical shape, the container bucket 12 may have its smaller diameter lower end placed within the ring 14, and its larger diameter upper end will preclude complete passage of the container bucket 12 through the ring 14, to capture the container 12 removably within the ring 14. In any event, it is also important that the ring 14 be devoid of any inwardly extending protrusions or projections, which may scratch or otherwise mar or damage the outer surface of the beverage container bucket 12.

The first support leg 16 is permanently secured (preferably welded, for strength) to the outer edge of the ring 14, at a joint 20. The weld attachment may be built up slightly as shown in the drawings to provide a sturdier joint 20 for the cantilevered ring 14. The first support leg 16 is formed in a generally C shaped smoothly rounded curve, to preclude sharp corners or edges which may lead to stress concentrations along the length of the element, and further to preclude sharp corners which may mar or otherwise damage the surface of a table T to which the present holder 10 is removably attached. The first leg 16 has a relatively long portion 22 curving downwardly and outwardly from the ring 14, and ending in a distal first end having a table lower contact point 24. This lower contact point 24 is adapted to contact and bear against the lower surface L of the table T when the holder 10 is placed on the table T. A relatively short portion 26 curves upwardly and outwardly from the ring 14, ending at a second end 28 opposite the first end and lower contact point 24.

The relatively short second support leg 18 forms a joint (preferably securely welded) at its central point, with the second end 28 of the first support leg 16. The second support leg 18 is transversely attached to the second end 28 of the first support leg 16, to define a generally T shaped configuration for the two support legs 16 and 18. The second leg 18 is arcuately formed to curve downwardly to a first end 30 and an opposite second end 32 to provide clearance from the table surface for any weld or other joint means, with the first end 30 and second end 32 respectively comprising a first table upper contact point and an opposite second table upper contact point, resting upon the upper surface U of the table T when the holder 10 is placed upon the table T.

Additional features may be provided with the present holder 10 to provide additional strength, utility, and/or attractiveness, as desired. For example, a decorative cover and/or reinforcement 34 for the support leg joint 28 may be provided to add additional thickness and strength to the joint, and to beautify the present holder 10. This decorative device 34 may comprise simulated grapes and leaves, in keeping with one of the primary purposes of the present holder 10, i. e., to hold a wine or champagne bucket removably therein.

Additional appearance enhancement and durability may be provided by plating at least the ring 14, first support leg 16, and second support leg 18 with an attractive plating of precious or other metals (gold, silver, brass, chrome, etc.), particularly when a standard steel is used for those components. Alternatively, the device may be formed of corrosion resistant "stainless" steel, either plated or unplated, for durability.

Another feature which may be desirable is the addition of resilient protective caps 36 disposed on each distal end 24, 30, and 32 of the first and second support legs 16/18. While such caps 36 do nothing to protect the beverage container holder 10 itself, they provide protection against marring, scratching, or otherwise damaging the table T, and particularly the upper surface U of the table T, where the unsightly appearance resulting from scratches or other damage is most undesirable. The relatively high coefficient of friction typically provided by such resilient caps (rubber, soft plastic, etc.) is also of value in providing a good grip for the present beverage container holder 10 when it is installed upon a table T.

Figure 2:
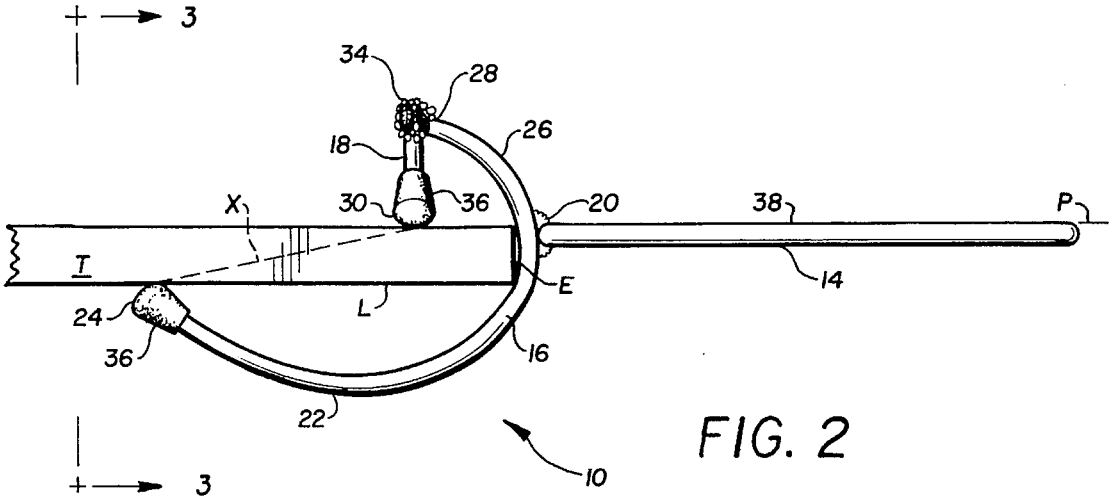
FIG. 2 is a side elevation view of the present beverage container holder, showing the means of removable attachment to a table or the like, and other details.
Figure 3:
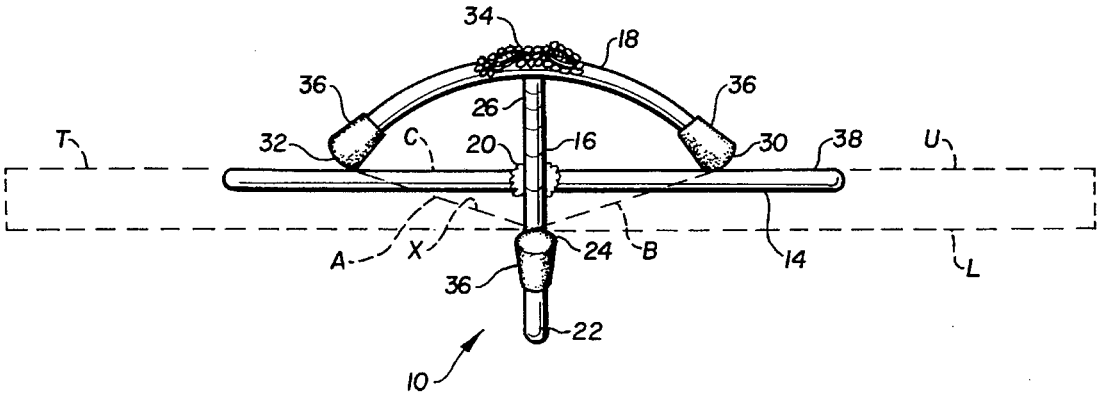

FIGS. 2 and 3 provide side and rear elevation views of the present holder 10 as it is secured to a table T or other generally flat and level platform or surface. Both FIGS. 2 and 3 clearly show that the ring 14 portion of the device is flat, with the upper surface 38 of the ring 14 defining a holder plane P. This holder plane P and upper surface 38 of the ring 14 are also coplanar with the two upper surface contact points or ends 30 and 32 of the second leg 18, which points 30/32 are also by definition coplanar with the upper surface U of a table T upon which they are resting. Thus, the configuration of the present holder 10 places the upper surface 38 of the ring portion 14 in coplanar alignment with the upper surface U of a table T upon which the device is placed. This provides additional convenience for the present holder 10, as a user of the device is accustomed to having a champagne bucket 12 or the like extending somewhat above the upper extremity of a floor supported or table supported bucket holder, but need not adjust or allow for any difference in height due to the holder 10 itself.

An examination of FIGS. 2 and 3 discloses the stable securing means provided by the three table contact points 24, 30, and 32 provided by the end components of the same numbers. These three contact points 24/30/32 are non-linear, and thus define the apices of a plane isosceles triangle X having legs A, B, and C, in accordance with geometric theory, which triangle X is disposed through the thickness of the table T between the lower contact point 24 and the two upper contact points 30/32. As noted above, the relatively longer lower portion 22 of the first support leg 16, places the first contact point relatively farther from the outer edge E of the table T, with the other two upper contact points 30/32 being relatively closer to the table edge E.

This offset positioning of the two upper contact points 30/32 relatively closer to the table edge E, with the longer lower portion 22 of the first leg 16 placing the lower contact point 24 further inwardly from the table edge E, results in a relatively long arm defined by the height of the triangle X between the base C (extending between the two upper contact points 30 and 32) and the apex, defined by the lower contact point 24 of the holder 10. Thus, when the holder 10 is placed upon a table T, the weight of the ring 14 disposed opposite the plane of the contact points 24/30/32 results in a moment being developed around the fulcrum of the device, defined by the upper contact points 30/32 and the line C therebetween. The effect of this moment, which is equal and opposite to that developed by the weight of the ring 14, is to create a force upward, on the underside U of the table T, at the lower contact point 24. The greater the mass place within the ring 14 (as by a champagne bucket 12 or the like, containing ice and a bottle of champagne or other beverage), the greater the weight (and grip) placed upon the fulcrum points 30/32 of the device, and the greater the upward force (and grip) developed at the lower contact point 24, and thus the greater the resistance of the holder 10 to slipping from the table T.

It should be noted that the thickness of the table T will affect the coplanar relationship of the ring 14 with the upper surface U of the table T (but not with the two upper contact points 30/32, as this relationship is independent of any table T). However, any reasonable table thickness may be adjusted for by bending the curve of the lower portion 22 of the first leg 16 accordingly. Greater curvature may be applied for thinner tables T, and less curvature for thicker tables T, as required.

While the height of the triangle X defined above provides the required arm and moment for the present holder 10 to grip a table T securely, the width of the triangle defined by the base C extending between the two upper contact points 30/32 provides the required stability for the device. It will be seen that the holder 10 cannot rock laterally, due to the essentially equal pressure developed at each laterally offset upper contact point 30/32, and cannot rock in the plane of the first leg, due to the locking action of the lower contact point 24 relative to the fulcrum defined by the two upper contact points 30/32 described above.

Thus, the present holder 10 provides an absolutely stable support for a beverage container 12, due to the minimum number of table contact points 24/30/32 required to define an attachment plane, as defined by the triangle X described above. Four or more attachment points, as in some articles of the prior art, may appear to provide more security, but invariably one contact point does not contact the surface securely, resulting in an unstable rocking of the device about the insecure contact point and its diagonally opposite member, as in a chair or table with one shorter leg.

The present beverage container holder 10 will thus be seen to add considerably to the ambience of a meal or other activity where iced beverages may be served, by eliminating the need for table space to be set aside for an ice bucket or other container for the beverage bottle, and further eliminating any requirement for a specialized (and costly) beverage container stand, and the floor space required of such a device. The present holder 10 is easily slipped onto the edge of a table T, with the two upper contact points 30/32 resting on the upper table surface U and the single lower contact point 24 bearing against the lower table surface L.

At this point, an appropriately shaped ice bucket, champagne bucket, etc., having a tapered cylindrical shape adapted to pass partially through the ring 14 of the present holder 10 (or at least some retaining means precluding passage completely through the ring 14 of the present holder 10) may be placed within the ring 14. The additional weight of the ice bucket, along with any contents (ice, champagne bottle, etc.) actually results in a more stable attachment of the present holder 10 to the table T, due to the increased pressure on the two upper fulcrum contact points 30/32 and the lower contact point 24. The coplanar relationship of the upper surface 38 of the ring 14 and the upper table surface U, places the contents of the present holder 10 readily at hand for persons seated at the table. When the meal or occasion has ended, the ice bucket or other contents of the ring 14 may be removed, with the light weight of the empty holder 10 allowing it to be slipped easily from the table T by lifting the ring portion 14 slightly and withdrawing it from the table. The small size of the present holder 10, in comparison to other table and floor stand type bucket holders, enables it to be stored easily until needed for a future occasion. Accordingly, the present holder 10 will be seen to be of great value for restaurants, caterers, persons who entertain in their homes, and virtually anyone who has occasion to serve iced beverages at table, and where table and floor space is at a premium and convenience is appreciated.

It is to be understood that the present invention is not limited to the sole embodiment described above, but encompasses any and all embodiments within the scope of the following claims.

I claim:

1. A beverage container holder, comprising:

a circular beverage container ring adapted to hold a beverage container therein, with said ring having an upper surface defining a holder plane;

a single elongate first support leg secured directly to said ring and normal to said holder plane, with said first leg having a long portion extending generally downwardly and outwardly from said ring with a first distal end having a single table lower contact point thereat, and an opposite short portion extending generally upwardly and outwardly from said ring, with said short portion having a second end opposite said first end;

a second support leg member having a central point thereon joined to and extending transversely across said second end of said first leg to form a generally T shaped configuration, with said second leg member central point and said second end of said first leg defining a support leg joint;

said second leg having a first end and an opposite second end, with said first end and said second end respectively comprising a first table upper contact point and an opposite second table upper contact point thereat, and;

said lower contact point of said first leg and said first and said second upper contact point of said second leg, providing three table contact points defining a stable triangular table attachment plane and providing for the cantilevered support of said beverage container ring when said beverage container holder is removably secured to a table by said lower contact point and said first and said second upper contact point gripping the table therebetween.

2. The beverage container holder of claim 1, wherein:

at least said first leg is smoothly curved and devoid of sharp corners, bends, and edges, in order to preclude concentrations of stress in said at least said first leg and damage to any table to which said beverage container holder is secured.

3. The beverage container holder of claim 1, wherein:

said second leg is smoothly downwardly curved with said first end and said second end of said second leg being disposed below said second end of said first leg to provide clearance between said contact leg joint and an underlying table surface.

4. The beverage container holder of claim 1, wherein:

said holder plane of said ring is coplanar with said first table upper contact point and said opposite second table upper contact point of said second leg.

5. The beverage container holder of claim 1, wherein:

at least said support leg joint includes decorative cover and reinforcement means for said joint, with said cover and reinforcement means comprising a decorative cover of simulated grapes and leaves for said joint.

6. The beverage container holder of claim 1, wherein:

said table lower contact point, said first table upper contact point, and said opposite second table upper contact point each include a resilient cap thereon serving to preclude the marring of and damage to the table lower and upper surfaces.

7. The beverage container holder of claim 1, wherein:

said ring, said first leg, and said second leg are each formed of metal rod having a round cross section.

8. The beverage container holder of claim 7, wherein:

said ring, said first leg, and said second leg are each formed of stainless steel.

9. The beverage container holder of claim 7, wherein:

at least said ring, said first leg, and said second leg are plated.

10. The beverage container holder of claim 7, wherein:

at least said ring, said first leg, and said second leg are plated with a metal selected from the group consisting of chrome, gold, silver, and brass.

11. A beverage container holder and beverage container therefor, comprising in combination:

a beverage container holder comprising a circular beverage container ring adapted to hold said beverage container therein and with said ring having an upper surface defining a holder plane, a single elongate first support leg secured directly to said ring and normal to said holder plane with said first leg having a long portion extending generally downwardly and outwardly from said ring with a first distal end having a single table lower contact point thereat and an opposite short portion extending generally upwardly and outwardly from said ring and with said short portion having a second end opposite said first end, and a second support leg member having a central point thereon joined to and extending transversely across said second end of said first leg to form a generally T shaped configuration with said second leg member central point and said second end of said first leg defining a contact leg joint and with said second leg having a first end and an opposite second end with said first end and said second end respectively comprising a first table upper contact point and an opposite second table upper contact point thereat and said lower contact point of said first leg and said first and said second upper contact point of said second leg providing three table contact points defining a stable triangular table attachment plane and providing for the cantilevered support of said beverage container ring when said beverage container holder is removably secured to a table by said lower contact point and said first and said second upper contact point gripping the table therebetween, and;

a tapered cylindrical beverage container adapted to be removably placed within said beverage container holder ring.

12. The beverage container holder and beverage container combination of claim 11, wherein:

at least said first leg of said beverage container holder is smoothly curved and devoid of sharp corners, bends, and edges, in order to preclude concentrations of stress in said at least said first leg and damage to any table to which said beverage container holder is secured.

13. The beverage container holder and beverage container combination of claim 11, wherein:

said second leg of said beverage container holder is smoothly downwardly curved with said first end and said second end of said second leg being disposed below said second end of said first leg to provide clearance between said contact leg joint and an underlying table surface.

14. The beverage container holder and beverage container combination of claim 11, wherein:

said holder plane of said ring of said beverage container holder is coplanar with said first table upper contact point and said opposite second table upper contact point of said second leg.

15. The beverage container holder and beverage container combination of claim 11, wherein:

at least said support leg joint of said beverage container holder includes decorative cover and reinforcement means for said joint, with said cover and reinforcement means comprising a decorative cover of simulated rapes and leaves for said joint.

16. The beverage container holder and beverage container combination of claim 11, wherein:

said table lower contact point, said first table upper contact point, and said opposite second table upper contact point of said beverage container holder each include a resilient cap thereon serving to preclude the marring of and damage to the table lower and upper surfaces.

17. The beverage container holder and beverage container combination of claim 11, wherein:

said ring, said first leg, and said second leg of said beverage container holder are each formed of metal rod having a round cross section.

18. The beverage container holder and beverage container combination of claim 17, wherein:

said ring, said first leg, and said second leg of said beverage container holder are each formed of stainless steel.

19. The beverage container holder and beverage container combination of claim 17, wherein:

at least said ring, said first leg, and said second leg of said beverage container holder are plated.

20. The beverage container holder and beverage container combination of claim 17, wherein:

at least said ring, said first leg, and said second leg of said beverage container holder are plated with a metal selected from the group consisting of chrome, gold, silver, and brass.

* * * * *